US008466864B2

(12) United States Patent
Munteanu et al.

(10) Patent No.: US 8,466,864 B2
(45) Date of Patent: Jun. 18, 2013

(54) GRAYSCALE-BASED FIELD-SEQUENTIAL DISPLAY FOR LOW POWER OPERATION

(75) Inventors: Eugen Munteanu, Austin, TX (US); Stefan Peana, Austin, TX (US); John M. Knadler, IV, Round Rock, TX (US)

(73) Assignee: Dell Products, LP, Round Rock, TX (US)

( * ) Notice: Subject to any disclaimer, the term of this patent is extended or adjusted under 35 U.S.C. 154(b) by 848 days.

(21) Appl. No.: 12/247,731

(22) Filed: Oct. 8, 2008

(65) Prior Publication Data

US 2010/0085289 A1 Apr. 8, 2010

(51) Int. Cl.
*G09G 3/36* (2006.01)

(52) U.S. Cl.
USPC ..... 345/88; 345/102; 345/89; 345/90; 345/94; 345/204; 345/690; 345/98; 345/99; 345/100; 345/692; 345/103; 362/97.2

(58) Field of Classification Search
USPC ..... 345/103, 102, 690, 211, 204, 209, 345/212–214, 87–90, 92, 94–96, 98–100, 345/83; 362/97.1–97.3
See application file for complete search history.

(56) References Cited

U.S. PATENT DOCUMENTS

| | | | | |
|---|---|---|---|---|
| 4,090,219 | A | 5/1978 | Ernstoff et al. | |
| 5,406,299 | A | 4/1995 | Post | |
| 5,748,164 | A | 5/1998 | Handschy et al. | |
| 6,069,676 | A | 5/2000 | Yuyama | |
| 6,144,359 | A * | 11/2000 | Grave | 345/102 |
| 6,320,568 | B1 * | 11/2001 | Zavracky | 345/101 |
| 6,324,006 | B1 | 11/2001 | Morgan | |
| 6,519,362 | B1 * | 2/2003 | Cusmariu | 382/176 |
| 6,563,479 | B2 * | 5/2003 | Weindorf et al. | 345/77 |
| 6,672,733 | B2 | 1/2004 | Nagatani | |
| 6,784,898 | B2 | 8/2004 | Lee et al. | |
| 7,046,221 | B1 | 5/2006 | Malzbender | |
| 7,053,880 | B2 | 5/2006 | Lim et al. | |
| 7,301,534 | B2 * | 11/2007 | Runolinna | 345/207 |
| 7,336,325 | B2 | 2/2008 | Hong | |
| 7,423,705 | B2 * | 9/2008 | Len-Li et al. | 349/61 |
| 2001/0008395 | A1 * | 7/2001 | Yamamoto et al. | 345/102 |
| 2002/0024529 | A1 * | 2/2002 | Miller et al. | 345/690 |
| 2003/0137485 | A1 * | 7/2003 | Wei et al. | 345/102 |
| 2003/0189211 | A1 * | 10/2003 | Dietz | 257/79 |
| 2003/0214242 | A1 * | 11/2003 | Berg-johansen | 315/169.3 |
| 2004/0036820 | A1 * | 2/2004 | Runolinna | 349/61 |
| 2005/0184983 | A1 * | 8/2005 | Brabander et al. | 345/204 |
| 2005/0259059 | A1 | 11/2005 | Park et al. | |

(Continued)

*Primary Examiner* — Lun-Yi Lao
*Assistant Examiner* — Olga Merkoulova
(74) *Attorney, Agent, or Firm* — Larson Newman, LLP

(57) ABSTRACT

A field-sequential display is operated in one of a color mode or a grayscale mode. In the color mode, a video source provides image content in the form of multiple-color image data having a frame rate of X Hz and a display controller uses the multiple-color image data to drive the field-sequential display so as provide multiple-color image content at the field-sequential display. In the grayscale mode, the display controller generates grayscale image data from the multiple-color image data and the display controller then drives the field-sequential display with the grayscale image data at a lower frame rate of Y Hz. While in the grayscale mode, the display controller can take advantage of the enhanced contrast provided by the grayscale image content to reduce or disable backlighting at the field-sequential display. The reduced timing requirements afforded by the lower frame rate, as well as the reduction or elimination of backlighting, can reduce power consumption compared to the color mode.

17 Claims, 4 Drawing Sheets

U.S. PATENT DOCUMENTS

2005/0270262 A1 12/2005 Oh
2006/0007098 A1* 1/2006 Tong et al. ..... 345/102
2007/0001951 A1 1/2007 Bhowmik et al.
2007/0205969 A1* 9/2007 Hagood et al. ..... 345/84
2008/0186334 A1 8/2008 Seetzen
2008/0198179 A1 8/2008 Doser

* cited by examiner

GRAYSCALE-BASED FIELD-SEQUENTIAL DISPLAY FOR LOW POWER OPERATION

FIELD OF THE DISCLOSURE

This disclosure relates generally to information handling systems, and more particularly to information handling systems utilizing a field-sequential display.

BACKGROUND

As the value and use of information continues to increase, individuals and businesses seek additional ways to process and store information. One option is an information handling system. An information handling system generally processes, compiles, stores, and/or communicates information or data for business, personal, or other purposes. Because technology and information handling needs and requirements can vary between different applications, information handling systems can also vary regarding what information is handled, how the information is handled, how much information is processed, stored, or communicated, and how quickly and efficiently the information can be processed, stored, or communicated. The variations in information handling systems allow for information handling systems to be general or configured for a specific user or specific use such as financial transaction processing, airline reservations, enterprise data storage, or global communications. In addition, information handling systems can include a variety of hardware and software components that can be configured to process, store, and communicate information and can include one or more computer systems, data storage systems, and networking systems.

Many information handling systems, including desktop and notebook computers, utilize a field-sequential display (e.g., a field-sequential liquid crystal display (LCD)) whereby each image frame is separated into its color components, and each color component is separately displayed in sequence. To illustrate, for a Red-Green-Blue (RGB)-based image signal, only the red pixel components of a multiple-color image frame (i.e., the "red field") are displayed, followed by the display of only the green pixel components of the image frame (i.e., the "green field"), and then only the blue pixel components of the image frame (i.e., the "blue field") are displayed. The corresponding color backlight is generated for the separate display of each color field. While displaying only one color component of a multiple-color image frame at a time can achieve greater image quality, to achieve a virtual multiple-color frame rate of X, the single-color frame sequence must be driven at a rate of at least N*X, whereby N is the number of color components in the multiple-color image frame. To illustrate, it typically is necessary to drive the field-sequential display at 180 Hertz (Hz) or more to achieve a virtual frame rate of 60 Hz in a RGB-based display while avoiding visual artifacts such as flicker or jitter. The timing requirements of this increased effective frame rate often results in increased power consumption, thereby adversely effecting the power requirements of the system.

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which.

The use of the same reference symbols in different drawings indicates similar or identical items.

DETAILED DESCRIPTION OF DRAWINGS

Figure 1:
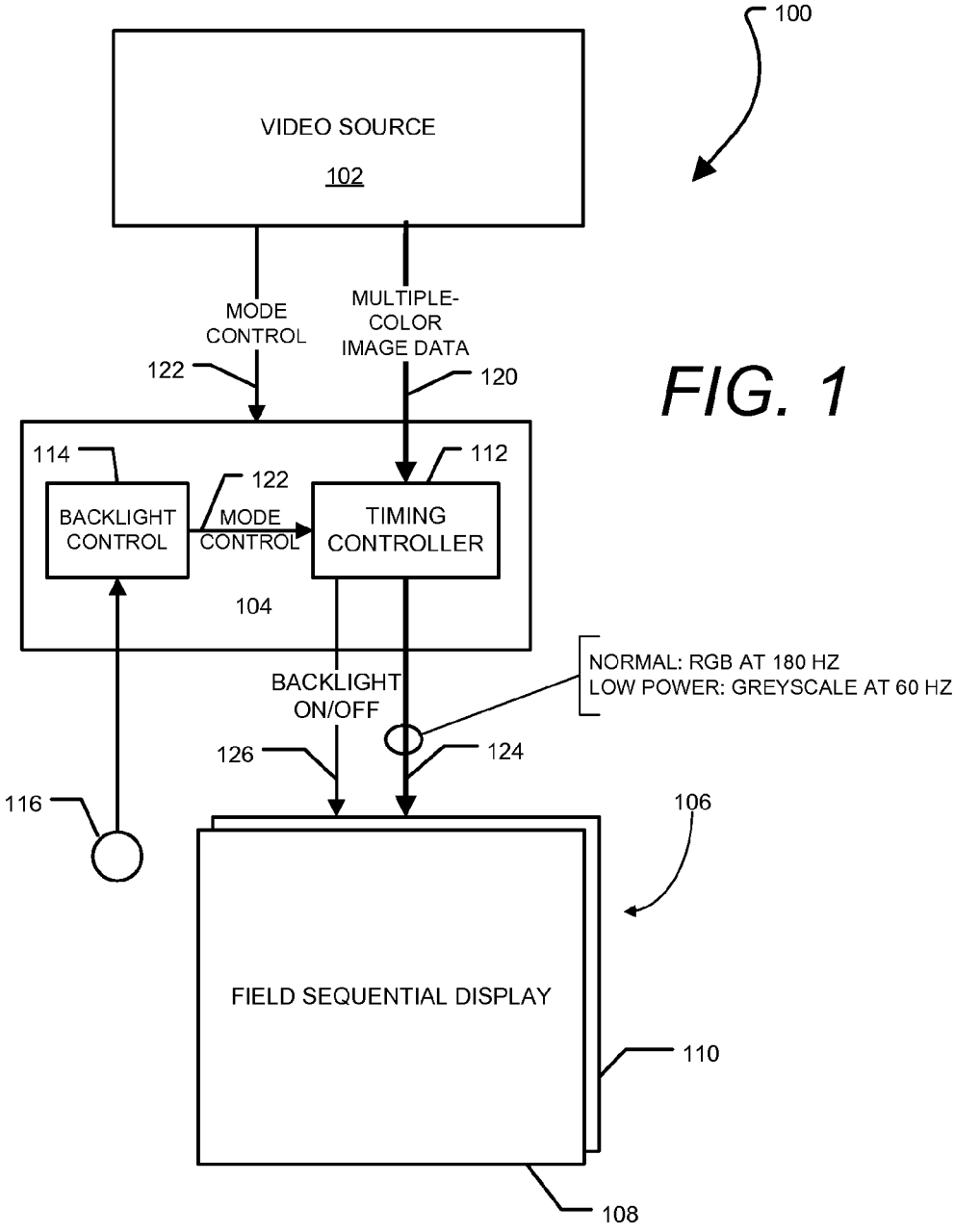
FIG. 1 illustrates a block diagram of a display system of an information handling system according to one aspect of the disclosure.

The following description in combination with the Figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be utilized in this application. The teachings can also be utilized in other applications and with several different types of architectures such as distributed computing architectures, client/server architectures, or middleware server architectures and associated components.

For purposes of this disclosure, an information handling system can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system can be a personal computer (e.g., a desktop computer or a notebook computer), a PDA, a consumer electronic device, a network server or storage device, a switch router, wireless router, or other network communication device, or any other suitable device and can vary in size, shape, performance, functionality, and price. The information handling system can include memory, one or more processing resources such as a central processing unit (CPU) or hardware or software control logic. Additional components of the information handling system can include one or more storage devices, one or more communications ports for communicating with external devices as well as various input and output (I/O) devices, such as a keyboard, a mouse, and a video display. The information handling system can also include one or more buses operable to transmit communications between the various hardware components.

FIGS. 1-4 illustrate example techniques for operating a field-sequential display in one of a color mode or a grayscale mode. In the color mode (e.g., the "normal" mode), a video source provides image content in the form of multiple-color image data (e.g., Red-Green-Blue (RGB) data) having a frame rate of X Hz (e.g., 180 Hz for RGB) and a display controller uses the multiple-color image data to drive the field-sequential display so as provide multiple-color image content at the field-sequential display. In the grayscale mode, the display controller generates grayscale image data from the multiple-color image data and the display controller then drives the field-sequential display with the grayscale image data at a lower frame rate of Y Hz (e.g., 60 Hz). Further, while in the grayscale mode, the display controller can take advantage of the enhanced contrast provided by the grayscale image content to reduce or disable backlighting at the field-sequential display. The reduced timing requirements afforded by the lower frame rate, as well as the reduction or elimination of backlighting, can reduce power consumption compared to the color mode.

FIG. 1 illustrates a display system 100 of an information handling system in accordance with at least one embodiment of the present disclosure. In the depicted example, the display system 100 includes a video source 102, a display controller 104, and a field-sequential display 106. The video source 102 can include any of a variety of video processing components configured to generate image content for display, including, but not limited to, a digital signal processor, a television tuner, a video decoder, and the like. The field-sequential display 106 includes a liquid crystal display 108 and a backlight 110. The liquid crystal display 108 can include, for example, a thin-film-transistor (TFT)-based active matrix LCD including one or more reflective films. The backlight 110 includes color-specific backlight sources, such as a red light emitting diode (LED)-based backlight, a blue LED-based backlight, and a green LED-based backlight. Alternately, the backlight 110 can implement a single light source (e.g., white LED or fluorescent) and a color wheel to achieve a particular backlight color at the appropriate times. The display controller 104 can include any of a variety of display controllers, such as, for example, a display controller compliant with one or more of a Digital Visual Interface (DVI) standard, a High-Definition Multimedia Interface (HDMI) standard, a DisplayPort standard, a television standard (e.g., NTSC or PAL), and the like. The display controller 104 includes a timing controller 112. In implementations whereby the display controller 104 independently controls the backlight 110 of the field-sequential display 106, the display controller 104 also can include, for example, a backlight controller 114 and an ambient light sensor 116.

In operation, the video source 102 generates multiple-color image data 120 representative of color image content to be displayed at the field-sequential display 106. In at least one embodiment, the multiple-color image data 120 is composed of different color intensity values (e.g., red, green, and blue intensity values), whereby the color intensity values may be provided together for each image frame (e.g., each pixel of the image frame is represented by a RGB intensity tuple) or the multiple-color image data 120 can be arranged such that each color component of an image frame is sent separately as a group (e.g., all of the red intensity values for an image frame are provided, then the blue intensity values, etc.).

The timing controller 112 includes an input to receive the multiple-color image data 120, an input to receive a mode control signal 122 indicating whether the display controller 104 is to operate in a normal mode (e.g., color mode) or a low-power mode (e.g., grayscale mode), and an output to provide image data 124 to the field-sequential display 106. The field-sequential display 106 controls the transparency of the elements of the transistor matrix of the LCD 108 based on the image data 124.

In one embodiment, the timing controller 112 configures the color format and the frame rate timing of the image data 124 based on the particular mode indicated by the mode control signal 122. Responsive to the mode control signal 122 indicating operation in the normal mode, the timing controller 112 uses the multiple-color image data 120 from the video source 102 to generate the image data 124 as multiple-color image data having the same frame rate and thereby driving the field-sequential display 106 in a conventional color sequential mode. Responsive to the mode control signal 122 indicating operation in the low-power mode, the timing controller 112 converts the multiple-color image data 120 to generate the image data 124 as grayscale image data having a lower frame rate timing. The timing controller 112 then drives the field-sequential display 106 using the grayscale image data. By driving the grayscale image data at a lower frame rate timing, reduction in the power requirements of the display system 100 can be achieved in the low-power mode.

With sufficient ambient light and an effective reflective film, the conversion and display of the multiple-color image data as grayscale image data typically provides sufficient grayscale contrast without requiring backlighting. Accordingly, in one embodiment, the timing controller 112 can control the backlight 110 via a backlight control signal 126 so as to enable the backlight 110 during the normal mode and to disable the backlight 110 during the low-power mode, thereby further reducing power consumption during the low-power mode. The backlight control signal 126 can enable or disable the backlight 110 by, for example, enabling or disabling a voltage input to the backlight 110, by directing a pulse width modulation (PWM) controller to provide a particular duty cycle signal to the backlight 110, or the like.

In one embodiment, the video source 102 or other component of the information handling system signals the particular mode of operation to the timing controller 112. To illustrate, notebook computers often use timers to identify when a certain minimum inactive period has occurred and, in response, place the system in a sleep or low-power mode. A signal from the video source or from the chipset of the system that is representative of whether the notebook computer is in a full-power or low-power mode therefore can serve as the mode control signal 122. Alternately, the display controller 104 can utilize the ambient light sensor 116 and the backlight controller 114 to control the mode of operation, to control the backlight 110, or a combination thereof. It will be appreciated that as the ambient light incident on the display surface increases, the effectiveness of the backlight 110 decreases. Accordingly, in one embodiment, the backlight controller 114 uses the output of the ambient light sensor 116 to determine whether the ambient light has exceeded a predetermined threshold, and if so, the backlight controller 114 can signal the timing controller 112 to disable the backlight 110, enter the low-power mode, or both.

Figure 2:
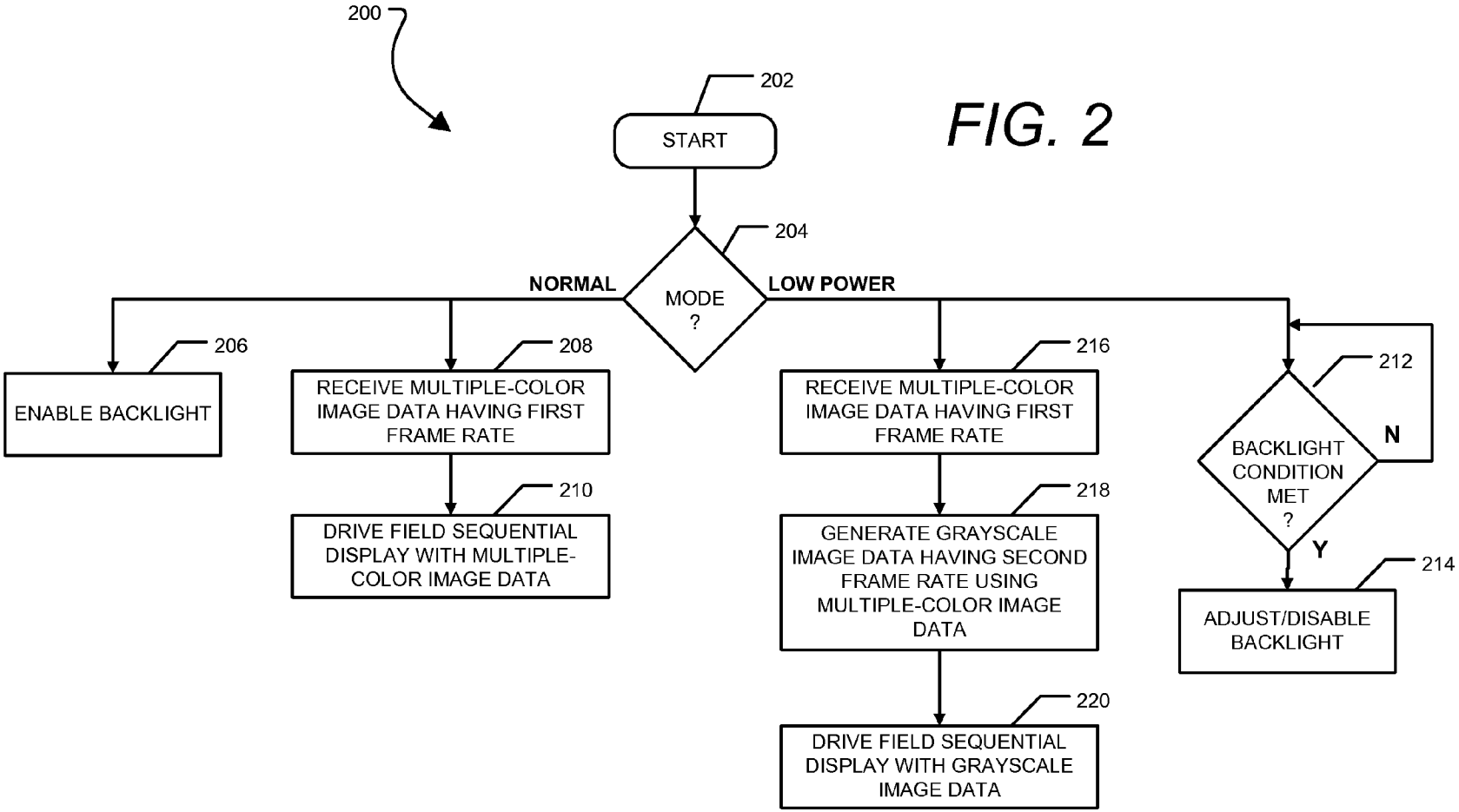
FIG. 2 illustrates a flow diagram of method of operation of the display system of FIG. 1 according to one aspect of the disclosure.

FIG. 2 illustrates an example method 200 of operation of the display system 100 of FIG. 1 in accordance with at least one embodiment of the present disclosure. The method 200 initiates at block 202, whereby the display system 100 is powered up or otherwise initialized. At block 204 the display controller 104 determines whether to operate in the normal mode or the low power mode. In one embodiment, the video source 102 or other component configures the mode control signal 122 to direct the timing controller 112 of the display controller 104 to operate in one of the normal mode or the low power mode based on, for example, the status of the information handling system (e.g., depending on whether the information handling system is active or idle, etc.). In an alternate embodiment, the backlight controller 114 uses the ambient light intensity detected by the ambient light sensor 116 to direct the timing controller 112 to operate in one of the normal mode or active mode.

In the event that the display controller 104 is to operate in the normal mode, at block 206 the timing controller 112 uses the backlight control signal 126 to enable the backlight 110 of the field-sequential display 106 if not already enabled. At block 208, the timing controller 112 receives the multiple-color image data 120 from the video source 208 and at block 210 the timing controller 112 drives the field-sequential display 110 using the multiple-color image data 120 so as to generate multiple-color image content at the field-sequential display 106.

In the event that the display controller 104 is to operate in the low-power mode, at block 212 the backlight controller determines whether a backlight condition is met so as to trigger the disabling of the backlight 110. If the backlight condition is met, at block 214 the timing controller 112 disables the backlight 110 or otherwise reduces the backlighting intensity. In one embodiment, the backlight condition is met when the display controller 104 receives an indication from the video source 102 that the backlight 110 is to be disabled. To illustrate, the video source 102 communicates with the display controller 104 using, for example, the High Definition Multimedia Interface (HDMI) standard, and whereby the video source 102 can use the Display Data Channel (DDC) of the HDMI communication link to provide a backlight enable/disable indicator to the display controller 104. In another embodiment, because backlighting becomes less effective at higher ambient light intensities (which also reduces image contrast in multiple-color images), the ambient light intensity is used to control the backlight 110. In this instance, the backlight controller 114 uses the signal from the ambient light sensor 116 to determine the ambient light intensity and compares this determined intensity with a predetermined threshold intensity. In the event that the ambient light intensity exceeds this threshold, the backlight controller 114 signals the timing controller 112 to disable the backlight 110. Otherwise, the threshold is not exceeded, the backlight controller 114 signals the timing controller 112 to permit the backlight 110 to remain enabled, or to use another criterion in determining whether to disable the backlight 110.

Also while in the low-power mode, at block 216 the display controller 104 receives the multiple-color image data 120 from the video source 102. However, rather than driving the field-sequential display 106 with the multiple-color image data 120, the timing controller 112 instead generates grayscale image data based on the multiple-color image data 120 at block 218. As described in greater detail with reference to FIG. 3, this conversion process can include a weighted sum of the color pixel component intensity values of the multiple-color image data 120 to generate a corresponding grayscale pixel value for the grayscale image data. As part of this process, the effective frame rate of the resulting grayscale image data is lowered compared to the original frame rate of the multiple-color image data. At block 210, the timing controller 112 drives the field-sequential display 106 using the grayscale image data at a lowered frame rate. To illustrate, if the multiple-color image data 120 comprises three color components (red, blue, and green) at a color-sequential frame rate of 180 Hz, the resulting grayscale conversion can result in a grayscale image data having a frame rate of 60 Hz, thereby reducing the timing and power requirements of the field-sequential display 106 while in the low-power mode.

Figure 3:
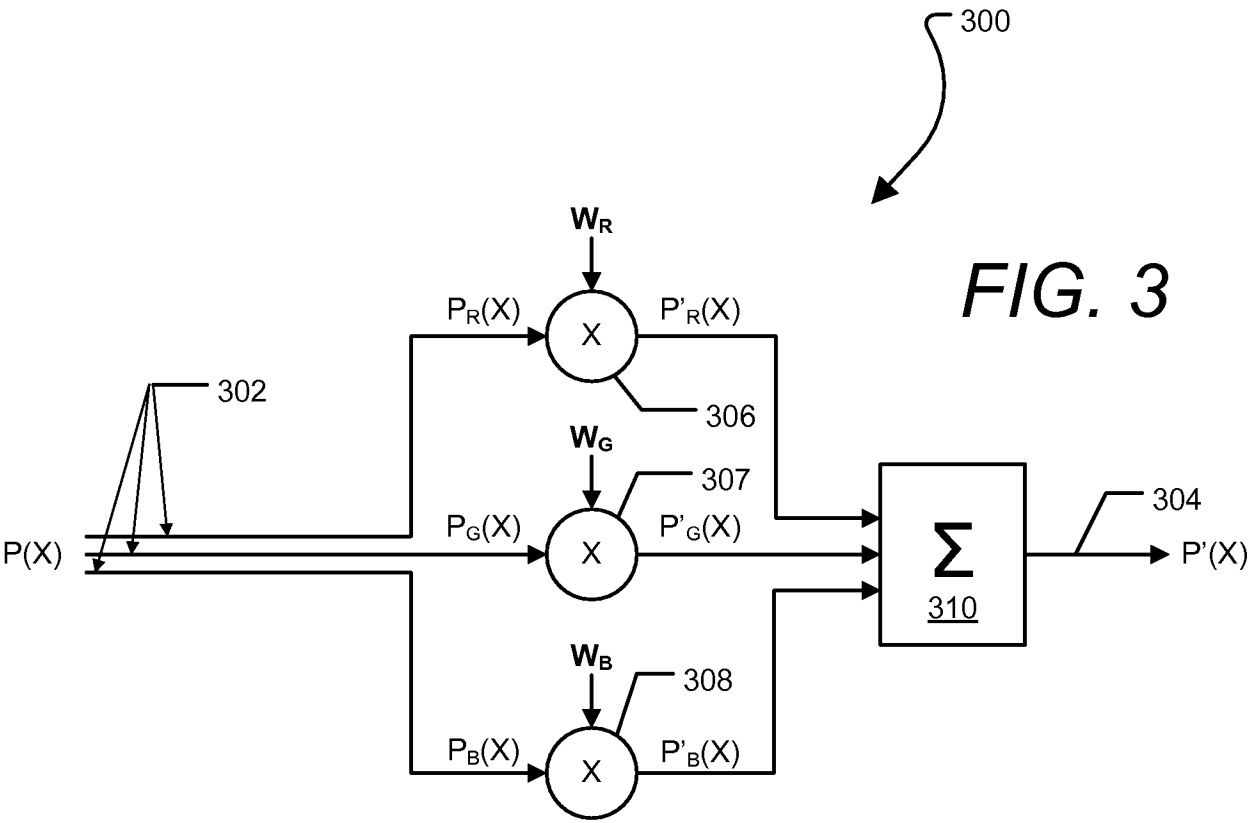
FIG. 3 illustrates a diagram of a process for converting multiple-color image data to grayscale image data according to one aspect of the disclosure.

FIG. 3 is a diagram illustrating a conversion means 300 for generating grayscale image data from multiple-color image data at the timing controller 112 in accordance with at least one embodiment of the present disclosure. The depicted conversion means 300 can be implemented as software executed by one or more processors, as hardware (e.g., dedicated logic or a programmable logic device), or a combination of executed software and hardware.

The conversion means 300 includes an input 302 to receive a pixel component P(X) comprising three color-specific components for red, blue and green (identified as color components $P_R(X)$, $P_B(X)$, and $P_G(X)$, respectively). The conversion means 300 further includes multipliers 306, 307, 308 (implemented as hardware-based multipliers or a multiplication software routine), and summer 310 (implemented as a hardware-based summer or a summation software routine). The multiplier 306 includes an input to receive the color component $P_R(X)$, an input to receive a weighting factor $W_R$, and an output to provide a modified color component $P'_R(X)$ resulting from a multiplication of the value of the color component $P_R(X)$ and the weighting factor $W_R$. Likewise, the multiplier 307 includes an input to receive the color component $P_G(X)$, an input to receive a weighting factor $W_G$, and an output to provide a modified color component $P'_G(X)$, and the multiplier 308 includes an input to receive the color component $P_B(X)$, an input to receive a weighting factor $W_B$, and an output to provide a modified color component $P'_B(X)$. The summer 310 includes an input to receive the modified color component $P'_R(X)$, an input to receive the modified color component $P'_G(X)$, and an input to receive the modified color component $P'_B(X)$. The summer 310 is configured to generate the modified pixel component P'(X) as a sum of the modified color components $P'_R(X)$, $P'_G(X)$, and $P'_B(X)$. Thus, the operation of the grayscale generation means 300 can be summarized in the equation:

$$P'(X)=P_R(X)*W_R+P_G(X)*W_G+P_B(X)*W_B$$

The particular values of the weighting factors WR, WG, and WB can be programmable or hardcoded and can be determined through empirical analysis. To illustrate, application of the equation above to weighting factors 0.3, 0.59, and 0.11 for red, blue and green, respectively, and an 18 bit RGB color pixel of {1C, 0A, 29} (in hexadecimal) would result in a 6 bit grayscale value of {13} (in hexadecimal) (1C*0.3+0A*0.59+29*0.11).

Figure 4:
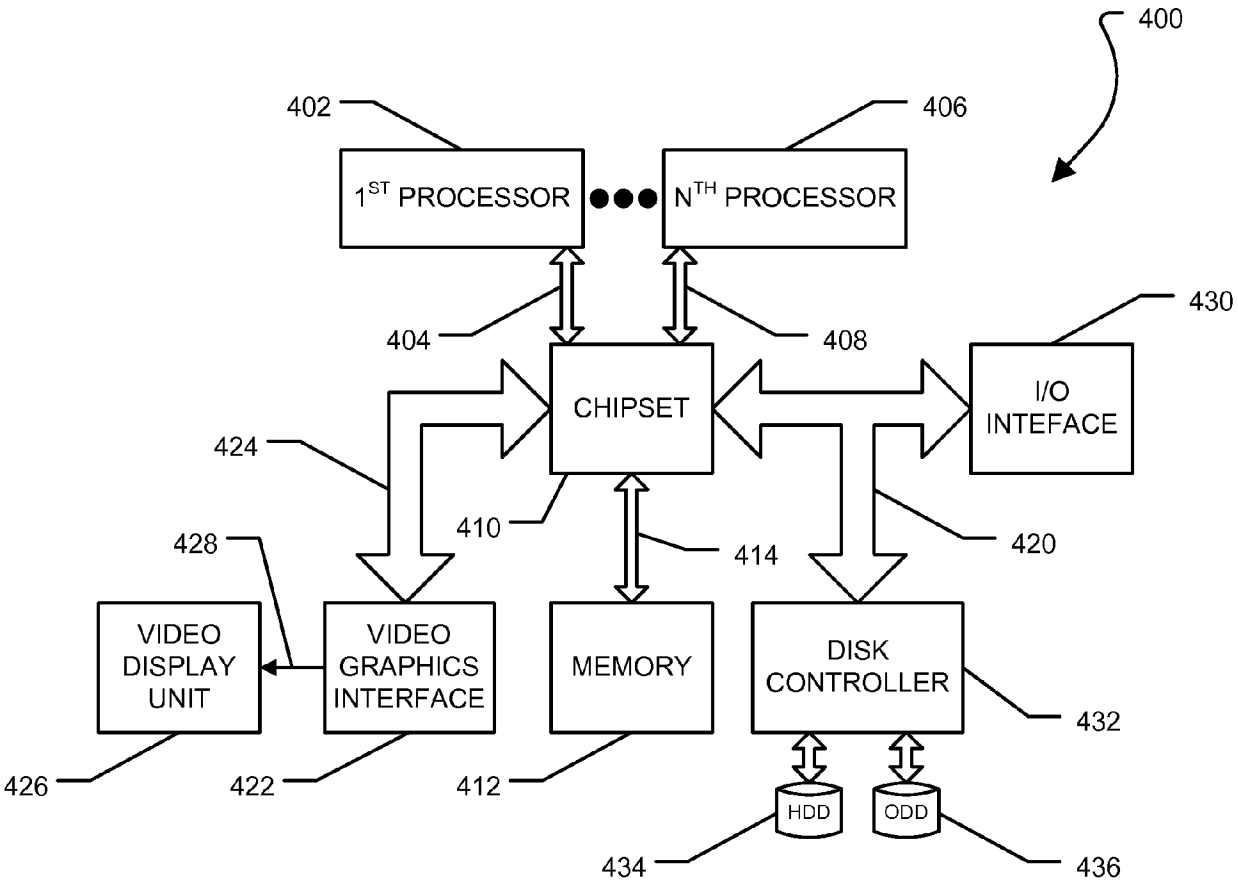
FIG. 4 illustrates a block diagram of an information handling system according to one aspect of the disclosure.

FIG. 4 illustrates an example information handling system 400 in which the display system 100 of FIG. 1 can be implemented in accordance with at least one embodiment of the present disclosure. In one form, the information handling system 400 can be a computer system such as a server. As shown in FIG. 4, the information handling system 400 can include a first physical processor 402 coupled to a first host bus 404 and can further include additional processors generally designated as $n^{th}$ physical processor 406 coupled to a second host bus 408. The first physical processor 402 can be coupled to a chipset 410 via the first host bus 404. Further, the $n^{th}$ physical processor 406 can be coupled to the chipset 410 via the second host bus 408. The chipset 410 can support multiple processors and can allow for simultaneous processing of multiple processors and support the exchange of information within information handling system 400 during multiple processing operations.

According to one aspect, the chipset 410 can be referred to as a memory hub or a memory controller. For example, the chipset 410 can include an Accelerated Hub Architecture (AHA) that uses a dedicated bus to transfer data between first physical processor 402 and the $n^{th}$ physical processor 406. For example, the chipset 410, including an AHA enabled-chipset, can include a memory controller hub and an input/output (I/O) controller hub. As a memory controller hub, the chipset 410 can function to provide access to first physical processor 402 using first bus 404 and $n^{th}$ physical processor 406 using the second host bus 408. The chipset 410 can also provide a memory interface for accessing memory 412 using a memory bus 414. In a particular embodiment, the buses 404, 408, and 414 can be individual buses or part of the same bus. The chipset 410 can also provide bus control and can handle transfers between the buses 404, 408, and 414.

According to another aspect, the chipset 410 can be generally considered an application specific chipset that provides connectivity to various buses, and integrates other system functions. For example, the chipset 410 can be provided using an Intel® Hub Architecture (IHA) chipset that can also include two parts, a Graphics and AGP Memory Controller Hub (GMCH) and an I/O Controller Hub (ICH). For example, an Intel 820E, an 815E chipset, or any combination thereof, available from the Intel Corporation of Santa Clara, Calif., can provide at least a portion of the chipset 410. The chipset 410 can also be packaged as an application specific integrated circuit (ASIC).

The information handling system 400 can also include a video graphics interface 422 that can be coupled to the chipset 410 using a third host bus 424. In one form, the video graphics interface 422 can be an Accelerated Graphics Port (AGP) interface to display content within a video display unit 426. Other graphics interfaces may also be used. The video graphics interface 422 can provide a video display output 428 to the video display unit 426. The video display unit 426 can include one or more types of video displays such as a flat panel display (FPD) or other type of display device.

The information handling system 400 can also include an I/O interface 430 that can be connected via an I/O bus 420 to the chipset 410. The I/O interface 430 and I/O bus 420 can include industry standard buses or proprietary buses and respective interfaces or controllers. For example, the I/O bus 420 can also include a Peripheral Component Interconnect (PCI) bus or a high speed PCI-Express bus. In one embodiment, a PCI bus can be operated at approximately 46 MHz and a PCI-Express bus can be operated at approximately 428 MHz. PCI buses and PCI-Express buses can be provided to comply with industry standards for connecting and communicating between various PCI-enabled hardware devices. Other buses can also be provided in association with, or independent of, the I/O bus 420 including, but not limited to, industry standard buses or proprietary buses, such as Industry Standard Architecture (ISA), Small Computer Serial Interface (SCSI), Inter-Integrated Circuit ($I^2C$), System Packet Interface (SPI), or Universal Serial buses (USBs).

In an alternate embodiment, the chipset 410 can be a chipset employing a Northbridge/Southbridge chipset configuration (not illustrated). For example, a Northbridge portion of the chipset 410 can communicate with the first physical processor 402 and can control interaction with the memory 412, the I/O bus 420 that can be operable as a PCI bus, and activities for the video graphics interface 422. The Northbridge portion can also communicate with the first physical processor 402 using first bus 404 and the second bus 408 coupled to the $n^{th}$ physical processor 406. The chipset 410 can also include a Southbridge portion (not illustrated) of the chipset 410 and can handle I/O functions of the chipset 410. The Southbridge portion can manage the basic forms of I/O such as Universal Serial Bus (USB), serial I/O, audio outputs, Integrated Drive Electronics (IDE), and ISA I/O for the information handling system 400.

Although only a few exemplary embodiments have been described in detail above, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. A method comprising: operating a field-sequential display in a first mode in response to an ambient light intensity being less than a threshold value and in a second mode in response to the ambient light intensity being greater than the threshold value;

in the first mode: receiving N-color image data, where N is a number of image color elements; driving the field-sequential display with the N-color image data at a first frame rate of 180 Hz, which is also can be calculated as N*F where F is a virtual frame rate; and enabling a backlight of the field-sequential display;

and in the second mode: receiving the N-color image data; converting the N-color image data to grayscale image data; driving the field-sequential display with the grayscale image data at a second frame rate of 60 Hz, the second frame rate less than the virtual frame rate; and disabling the backlight of the field-sequential display via a pulse-width modulation controller to provide a duty cycle to the backlight; wherein converting the N-color image data to the grayscale image data comprises generating a grayscale pixel value based on a weighted sum of corresponding color component pixel values, such that $P(X)=P_R(X)*W_R+P_G(X)*W_G+P_B(X)*W_B$ where P(X) is the grayscale pixel value, $P_R(X)$ is a corresponding red pixel value, $W_R$ is a red weighting value, $P_G(X)$ is a corresponding green pixel value, $W_G$ is a green weighting value, $P_B(X)$ is a corresponding blue pixel value, and $W_B$ is a blue weighting value.

2. The method of claim 1, wherein:

the N-color image data comprises red-green-blue (RGB) image data; and the virtual frame rate is at least three times the second frame rate.

3. The method of claim 1, wherein operating the field-sequential display in the first mode and in the second mode comprises:

determining the ambient light intensity for the field-sequential display based upon an ambient light sensor.

4. The method of claim 1, further comprising:

in the second mode:

determining an ambient light intensity for the field-sequential display; and adjusting a backlighting intensity of the field-sequential display based on the ambient light intensity.

5. The method of claim 1, wherein the red weighting value is 0.3, the green weighting value is 0.59, and the blue weighting value is 0.11.

6. A display controller configured to operate a field-sequential display in a first mode and a second mode, the display controller comprising:

a backlight control operable to enable a backlight of the field-sequential display in the first mode and to disable the backlight via a pulse-width modulation controller to provide a duty cycle to the backlight in the second mode; and a timing controller comprising a first input to receive N-color image data, where N is a number of image color elements, the N-color image data having a first frame rate of N*F, where F is a virtual frame rate, and an output adapted to be coupled to a field-sequential display, wherein the timing controller is configured to:

drive the field-sequential display with the N-color image data in the first mode at a first frame rate of 180 Hz;

drive the field-sequential display with a grayscale image data in the second mode at a second frame rate of 60 Hz; and convert the N-color image data to the grayscale image data in the second mode, wherein the conversion is based on a weighted sum of corresponding color component pixel values of the N-color image data, such that:

$$P(X)=P_R(X)*W_R+P_G(X)*W_G+P_B(X)*W_B$$

where P(X) is the grayscale pixel value, $P_R(X)$ is a corresponding red pixel value, $W_R$ is a red weighting value, $P_G(X)$ is a corresponding green pixel value, $W_G$ is a green weighting value, $P_B(X)$ is a corresponding blue pixel value, and $W_B$ is a blue weighting value.

7. The display controller of claim 6, wherein the timing controller further comprises a second input to receive a control signal, the timing controller configured to operate in one of the first mode or the second mode responsive to the control signal.

8. The display controller of claim 7, further comprising:

an ambient light sensor comprising an output coupled to the second input of the timing controller, the ambient light sensor configured to generate the control signal responsive to a detected ambient light intensity associated with the field-sequential display.

9. The display controller of claim 8, wherein the timing controller is configured to:

enable a backlight of the field-sequential display in the first mode; and disable the backlight of the field-sequential display in the second mode.

10. The display controller of claim 6, wherein the red weighting value is 0.3, the green weighting value is 0.59, and the blue weighting value is 0.11.

11. An information handling system comprising:

a display interface configured to be coupled to a field-sequential display;

a video source configured to generate a N-color image data, where N is a number of image color elements, the N-color image data having a first frame rate of 180 Hz; and a display controller configured to:

in a first mode, drive, via the display interface, the field-sequential display with the N-color image data at the first frame rate, and enable a backlight of the field-sequential display;

in a second mode, drive, via the display interface, the field-sequential display with a grayscale image data at a second frame rate of 60 Hz, and disable the backlight via a pulse-width modulation controller to provide a duty cycle to the backlight; and convert the N-color image data to the grayscale image data, wherein the conversion is based on a weighted sum of corresponding color component pixel values of the N-color image data, such that:

$$P(X)=P_R(X)*W_R+P_G(X)*W_G+P_B(X)*W_B$$

where P(X) is the grayscale pixel value, $P_R(X)$ is a corresponding red pixel value, $W_R$ is a red weighting value, $P_G(X)$ is a corresponding green pixel value, $W_G$ is a green weighting value, $P_B(X)$ is a corresponding blue pixel value, and $W_B$ is a blue weighting value.

12. The information handling system of claim 11, wherein the information handling system comprises at least one selected from a group consisting of: a desktop computer; a notebook computer; a personal digital assistant; a wireless phone; a navigational unit; and an in-vehicle user interface system.

13. The information handling system of claim 11, further comprising:

the field-sequential display.

14. The information handling system of claim 11, further comprising:

an ambient light sensor configured to provide a control signal representative of an ambient light intensity associated with the field-sequential display; and wherein the display controller is configured to operate in the second mode responsive to the control signal indicating the ambient light intensity is greater than a predetermined threshold.

15. The information handling system of claim 14, wherein the display controller is configured to:

disable a backlight of the field-sequential display responsive to the control signal indicating the ambient light intensity is greater than the predetermined threshold.

16. The information handling system of claim 14, wherein the display controller is configured to:

adjust, via the display interface, a backlight intensity at the field-sequential display responsive to the ambient light intensity represented by the control signal.

17. The information handling system of claim 11, wherein the red weighting value is 0.3, the green weighting value is 0.59, and the blue weighting value is 0.11.

* * * * *